US009420853B2

(12) United States Patent
La Rocca et al.

(10) Patent No.: US 9,420,853 B2
(45) Date of Patent: Aug. 23, 2016

(54) SLIDE FASTENER WITH FLAT ELEMENTS

(75) Inventors: Giovanni La Rocca, Prarolo (IT); Naoyuki Himi, Chesire (GB); Futoshi Kozato, Prarolo (IT); Kiyoyuki Okuyama, Yamagata (JP)

(73) Assignee: YKK Corporation (JP)

( * ) Notice: Subject to any disclaimer, the term of this patent is extended or adjusted under 35 U.S.C. 154(b) by 673 days.

(21) Appl. No.: 13/389,651

(22) PCT Filed: Aug. 26, 2010

(86) PCT No.: PCT/GB2010/001618
§ 371 (c)(1),
(2), (4) Date: Feb. 9, 2012

(87) PCT Pub. No.: WO2011/023956
PCT Pub. Date: Mar. 3, 2011

(65) Prior Publication Data

US 2012/0137476 A1 Jun. 7, 2012

(30) Foreign Application Priority Data

Aug. 26, 2009 (GB) ..... 0914903.0

(51) Int. Cl.

| | |
|---|---|
| ***A44B 19/04*** | (2006.01) |
| ***A44B 19/06*** | (2006.01) |
| ***A44B 19/08*** | (2006.01) |
| *A44B 19/24* | (2006.01) |

(52) U.S. Cl.
CPC ..... *A44B 19/06* (2013.01); *A44B 19/08* (2013.01); *A44B 19/24* (2013.01); *Y10T 24/2543* (2015.01); *Y10T 24/2552* (2015.01)

(58) Field of Classification Search
CPC ..... A44B 19/02; A44B 19/04; A44B 19/06; A44B 19/24; Y10T 24/2552; Y10T 24/2543; Y10T 24/2557
USPC ..... 24/405, 409
See application file for complete search history.

(56) References Cited

U.S. PATENT DOCUMENTS

| | | | |
|---|---|---|---|
| 2,526,600 | A | 10/1950 | Bolten |
| 2,862,272 | A | 12/1958 | Morin |
| 3,874,038 | A | 4/1975 | Takamatsu |

(Continued)

FOREIGN PATENT DOCUMENTS

| | | | |
|---|---|---|---|
| CN | 1596792 | A | 3/2005 |
| CN | 1714696 | A | 1/2006 |

(Continued)

OTHER PUBLICATIONS

Office Action, Japanese Patent Application No. 2012-510368, mailed Oct. 30, 2012.

(Continued)

*Primary Examiner* — Robert J Sandy
*Assistant Examiner* — Michael Lee
(74) *Attorney, Agent, or Firm* — Kilpatrick Townsend & Stockton LLP

(57) ABSTRACT

A slide fastener is provided. Each of a pair of first and second stringers includes a tape and a row of coupling elements mounted on a longitudinal edge of the tape. Each of the coupling elements comprises a first non-connecting portion at an upper side of the tape and a second connecting portion at a lower side of the tape. The second connecting portion comprises a head portion and a body portion. The head portion is engageable with a head portion of opposing coupling element. The body portion is fixed to the tape.

5 Claims, 5 Drawing Sheets

(56) References Cited

U.S. PATENT DOCUMENTS

| | | | | |
|---|---|---|---|---|
| 7,320,158 | B2 | 1/2008 | Deto et al. | |
| 7,337,509 | B2 | 3/2008 | Kondo et al. | |
| 7,353,570 | B2 | 4/2008 | Himi | |
| 8,539,650 | B2 * | 9/2013 | Kojima et al. | 24/410 |
| 2006/0130292 | A1 * | 6/2006 | Kondo et al. | 24/403 |
| 2007/0209169 | A1 | 9/2007 | Shay | |

FOREIGN PATENT DOCUMENTS

| | | | |
|---|---|---|---|
| JP | 49-50107 | A | 5/1974 |
| WO | 2005/101974 | | 11/2005 |
| WO | 2010/082291 | | 7/2010 |

OTHER PUBLICATIONS

Office Action, Japanese Patent Application No. 2012-510368, mailed Mar. 5, 2013.

International Search Report and Written Opinion, PCT International Application No. PCT/GB2010/001618, mailed Feb. 9, 2011.

Office Action, Chinese Patent Application No. 201080037794.9, mailed May 12, 2015.

* cited by examiner

SLIDE FASTENER WITH FLAT ELEMENTS

This application is a national stage application of PCT/GB2010/001618, which claims priority to GB 0914903.0, both of which are incorporated herein by reference.

FIELD

The present invention relates to a slide fastener. More specifically to a slide fastener with a simplified connection mechanism whereby the fastening or coupling elements do not appear to engage on a front face of the slide fastener thereby allowing superior abutment of opposing fastening elements whilst still providing enhanced flexibility of the slide fastener in the closed position.

BACKGROUND

With the ever present desire to produce new designs for the fashion and home furnishings industries the nature of the slide or zip fastener on a particular garment or article can have a significant effect on the overall look of the finished article.

In addition, however, whilst having an attractive appearance, a slide fastener has a functional role and is often key to the garment or home furnishing.

A problem associated with slide fasteners is the inherent nature of the coupling or fastening elements or teeth that form the closure mechanism for the slide fastener to receive foreign materials. The presence of the foreign materials, if left unchecked may damage the closure mechanism by preventing movement of a slider along the length of the slide fastener. In addition, removal of the foreign body may result in damage to the coupling elements or teeth such that the fastener may no longer close.

Furthermore, in many slide fasteners the coupling or fastening elements may also provide rough edges, particularly when metal teeth are used as the coupling elements such that if a piece of for example a garment does become entangled in the slide fastener, the mode of operation of the slide fastener may damage the garment as the slide fastener is closed and then reopened to free the garment from the slide fastener.

There is therefore a need to provide a slide fastener with a closure mechanism which does not possess any rough edges on the coupling elements, which is attractive in appearance and which still possesses an efficient closure compared with existing slide fasteners.

In conventional slide fasteners there is usually provided a pair of fastener tapes upon which are mounted rows of individual coupling elements which cooperate and interdigitate when the fastener tapes pass through a slider mounted on one of the fastener tapes and in so doing either close or open the slide fastener accordingly.

However, the interdigitation of the coupling elements has a limiting effect on the visible appearance of the slide fastener. That is, due to the required interconnection of the coupling elements needed to ensure a sufficient closing of the slide fastener, the design of the external appearance of the slide fastener has been strictly limited.

In addition, the interconnection of the coupling elements visible to the user on the front and rear of the fastener has limited the flexibility of the slide fastener in the closed position and also the separation between the individual fastener elements on opposing fastener tapes.

For example, in U.S. Pat. No. 7,320,158 B2 (YKK Corporation) there is described a fastener with two fastener tapes in which the individual magnetic elements mounted on the opposed inner longitudinal edges of two fastener tapes at predetermined intervals are each adapted to fit between and be attracted to two mating magnetic elements mounted on the opposite fastener tape. Whilst this invention overcomes the problem of unsightly slide fastener closures and provides an attractive and smooth fastener, the strength of the fastener is limited by the strength and hence size of the magnets employed on the fastener tapes.

In WO 2005/101974 (Artzip Ltd) there is disclosed a zipper comprising two opposed rows of discrete interlocking elements wherein each of the interlocking elements carries a design or a fragment thereof for example, a trademark, logo or emblem. Whilst WO 2005/101974 details fastening elements wherein the front face of the fastening elements comprise a different design to the rear face of the fastening elements, the interdigitation between the individual fastening elements on opposing sides of the fastener tapes comprising the zipper is reduced thereby resulting in a weakened slide fastener or zipper.

In addition, the elaborate nature of the fastening elements on the front face of the slide fastener means that excessive flexing of the slide fastener when in the closed position may impair the closure of the fastener elements and therefore overall lead to a zipper with reduced flexibility.

In U.S. Pat. No. 7,353,570 (YKK Corporation) there is described a fastener chain in which fastener elements each formed into a single unit of synthetic resin are attached at a constant interval along opposing side edges of a pair of fastener tapes. Each fastener element comprises a front surface portion and a rear surface portion which are different with respect to one another. Both faces of the fastener elements are intricately fabricated thereby producing a fastener chain with an improved tactile feel and appearance but with a complicated design thereby making the fastener expensive and difficult to produce.

Finally, in U.S. Pat. No. 7,337,509 (YKK Corporation) there is described a slide fastener wherein the fastener elements comprise a main body element constituted of a base portion attached to a fastener tape, a neck portion and an engaging head portion continuous from the neck portion. Also present is a stiffening means on the main body element allowing the surface stringers to bend when the elements are separated and inhibiting the fastener chain from bending when the elements are engaged in a stiffening condition.

SUMMARY

The present invention overcomes the problems associated with the prior art zippers in that the reduced interdigitation of the coupling elements on the front face of the slide fastener allows the coupling elements on the front face to abut more closely. As a result, the gap between the closed coupling elements is reduced providing a sleek, smooth and attractive appearance of the slide fastener.

Surprisingly, the inventors of the present invention have also found that the herein described interdigitation of the coupling elements on the reverse of the slide fastener still provides a sufficiently strong and effective slide fastener when the coupling elements are in the closed position. That is, the strength of the closure mechanism is not impaired as a result of the change in shape of the coupling elements.

In addition, the present invention provides a slide fastener which has a sleek appearance with closely abutting coupling elements which engage or interconnect on the rear of the slide fastener only and hence cause less or no damage to any material to which the slide fastener is attached and which may become caught in the slide fastener, yet still provide a slide fastener of superior strength and with improved flexibility along the length of the slide fastener.

In addition, the present application is provided with waterproofing features which enables the slide fastener to be used for garments or items subject to inclement weather conditions and for which there is little interference with the coupling elements by the waterproofing features.

The present invention finds particular application as an improved slide fastener for the clothing and soft furnishings industry, but it not limited thereto.

The present invention therefore seeks to address the problems outlined above and provides an improved slide fastener that is able to meet the strength of modern slide fasteners and the aesthetic requirements of modern designs.

Therefore according to a first aspect of the present invention there is provided a slide fastener comprising:

a pair of first and second stringers each comprising a tape and a row of coupling elements mounted on a longitudinal edge of the tape, wherein:

each of the coupling elements comprises a first non-connecting portion at an upper side of the tape and a second connecting portion at a lower side of the tape, the first non-connecting portion is substantially square or substantially rectangular, the second connecting portion comprises a head portion and a body portion, the head portion is engageable with a head portion of opposing coupling element, and the body portion is fixed to the tape.

The slide fastener may further comprising a slider having flanges defining therebetween a channel through which the coupling elements pass, the slider adapted to slidably move along the rows of the coupling elements.

The second connecting portion may be longer than the first non-connecting portion so that the head portion of the second connecting portion extends beyond the first non-connecting portion.

When the second connecting portions on adjacent coupling elements on opposing tapes interconnect, the first non-connecting portions may abut.

In addition, the second interconnecting portion of the coupling element has a head region which in the closed position may substantially abut the head region of opposing coupling elements.

The first non-connecting portion of the coupling element of the slide fastener according to the present invention may be substantially square, or substantially rectangular, the second connecting portion of the coupling element of the slide fastener according to the present invention may be substantially mushroom shaped or substantially arrow shaped. When the second connecting portion of the coupling element is substantially arrow shaped, the coupling element is preferably blunted.

The first non-connecting portion may have a flat upper surface.

The first non-connecting portion may have a front surface opposing in a front and rear direction of the coupling element when the head portion engages with the head portion of the opposing coupling element.

A preferred aspect of the present invention is that the coupling elements may be comprised of plastics material or comprised of metal.

In addition, the slide fastener according to the present invention comprises a coating of polymeric material provided on at least one surface of the tape. This polymeric material may provide a waterproof feature to the stringers of the present invention.

The polymeric material may comprise at least one of a thermoplastic material and a thermoplastic elastomer and preferably extends continuously along the at least one surface of the tape.

The polymeric material may be applied to the slide fastener by extrusion onto a surface of the tape or alternatively the polymeric material may be laminated onto the surface of the tape.

It is preferred that the polymeric material comprises polyurethane.

In addition, the layer of polymeric material may further comprise a printed pattern.

It is also preferred the thermoplastic material forms a waterproof layer on the tapes of the slide fastener that substantially abuts the couplings elements.

Furthermore, the tapes may be comprised of yarn which is comprised of hydrophobic material and/or the tapes may be made of fabric treated with a hydrophobic material, thereby improving the waterproof characteristics of the slide fastener when in use.

According to a second aspect of the present invention there is provided the use of a slide fastener according to the first aspect of the present invention in clothing, furnishings or equipment.

Further aspects and preferred features of the invention will be apparent from the following description and the accompanying claims.

DETAILED DESCRIPTION OF THE EMBODIMENTS

The invention will now be further described by way of embodiments with reference to the accompanying drawings.

Figure 1:
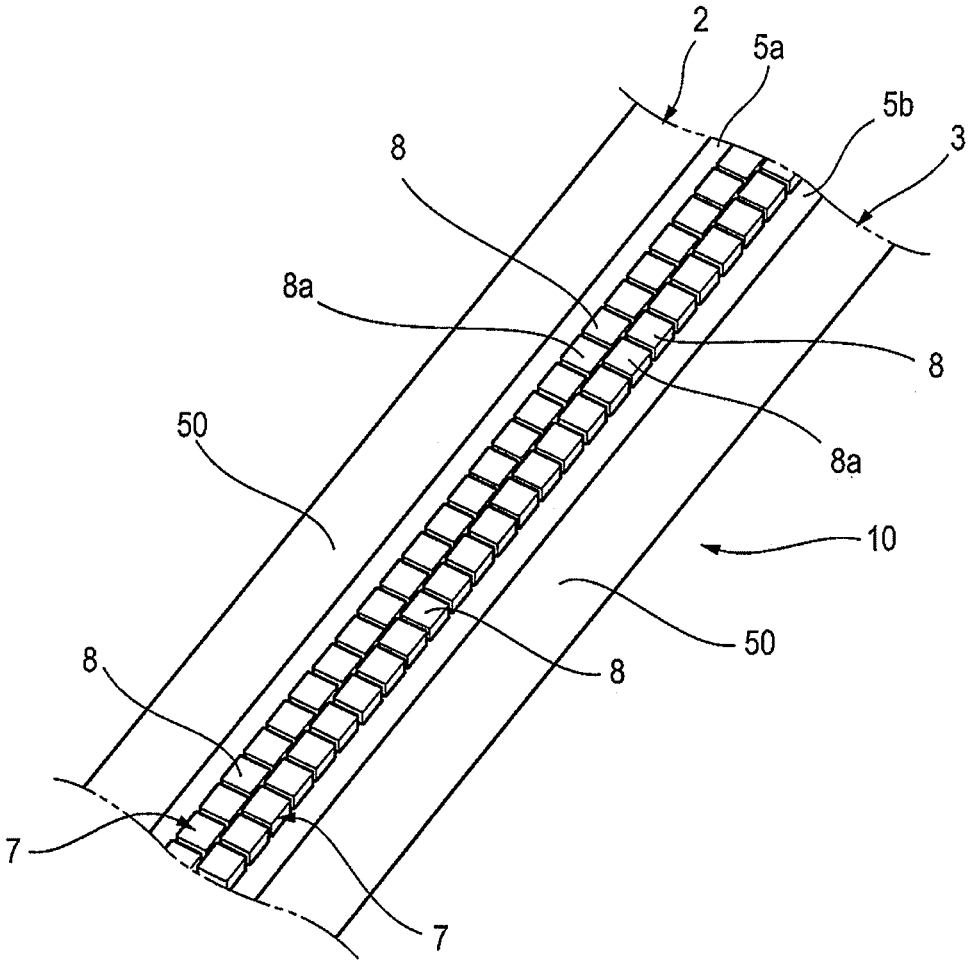
FIG. 1 is a perspective view of a first (front) face of a slide fastener according to a first embodiment of the present invention in the closed position.

Referring to FIG. 1 there is illustrated a slide fastener in accordance with a first embodiment of the present invention. In FIG. 1 (a slider of the slide fastener omitted for clarity) illustrates the slide fastener in a substantially closed position.

The slide fastener 10 of FIG. 1 comprises a first stringer 2 and a second stringer 3. Each stringer 2, 3 is comprised of a tape 5*a*, 5*b* and has a cord (not shown) which protrudes from an upper surface and a lower surface of the tape along opposing longitudinal edges of the tape 5*a*, 5*b* and upon which coupling elements 7 are mounted. The slider (not shown) preferably comprises a pull-tab to allow a user to move the slider along the elements 7 of the slide fastener 10.

Figure 2:
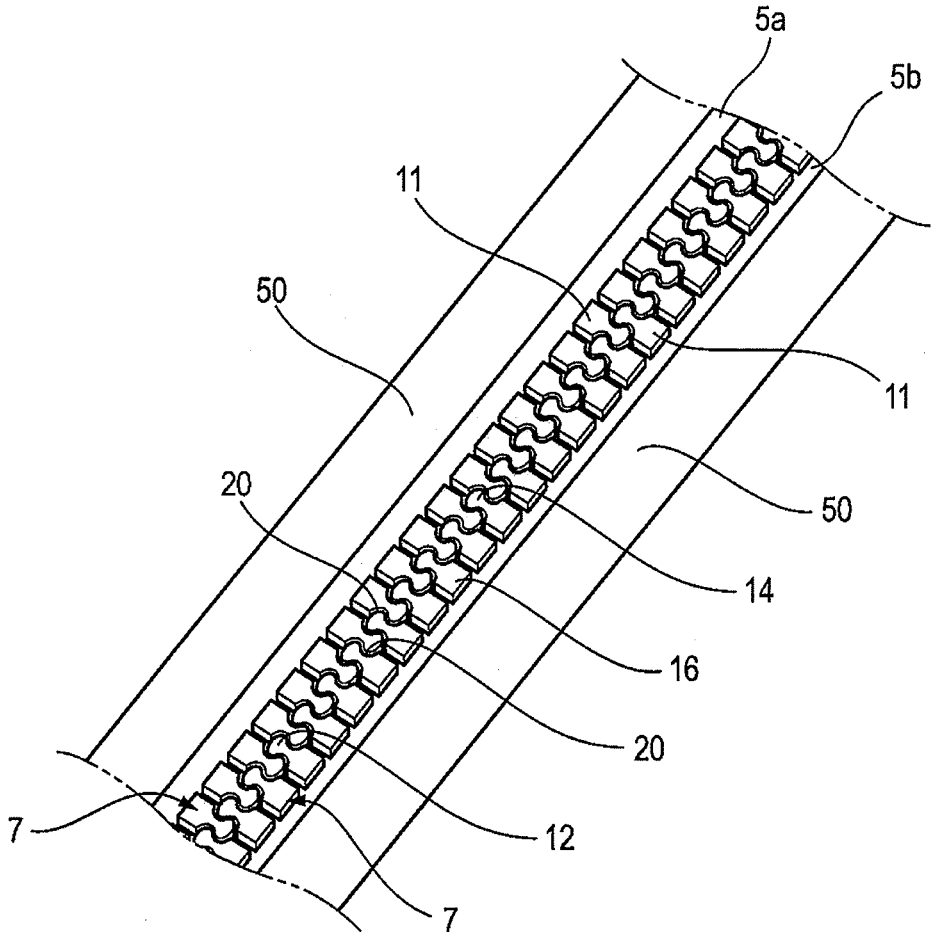
FIG. 2 is a perspective view of a second (rear) face of the slide fastener shown in FIG. 1 according to the first embodiment of the present invention in the closed position.

In accordance with the present invention the tape 5*a*, 5*b* may further comprise a layer of fabric coated or laminated with a layer of water resistant or water repelling material such as for example a polyurethane film. In FIGS. 1 and 2, such a coating layer 50 is shown. Alternatively, or in addition thereto, the fabric tapes may be comprised of hydrophobic yarn or the tapes may have been treated with a hydrophobic treatment or preparation.

In the embodiment of the slide fastener 10 illustrated in FIG. 1, the coupling elements 7 are comprised of plastic material and have been prepared by die-cast injection moulding. The coupling elements 7 are mounted along the cord by traditional means. However, it will be appreciated that alternative coupling elements could be utilized, for example metal coupling elements could be utilized.

At one end of the stringers 2, 3 the slide fastener 10 may comprise a retaining box (not shown) and an insert pin (not shown). The box pin arrangement is mounted on the respective tapes 5*a*, 5*b* to enable the stringers 2, 3 to be separately coupled together.

The slider is preferably mounted on the coupling elements 7 of one of the stringers 2 or 3, to allow movement of the slider between the retaining box and a releasing end (also not shown). The first and second stringers 2, 3 of the slide fastener 10 may be separable.

A key feature of the slide fastener of the present invention as illustrated in the Figures is the nature of the coupling elements and hence closure mechanism of the slide fastener.

The design of the coupling elements enables the slide fastener to be utilized in situations where substantially smooth and 'close-fitting' or 'close-packing' coupling elements is required.

Figure 8:
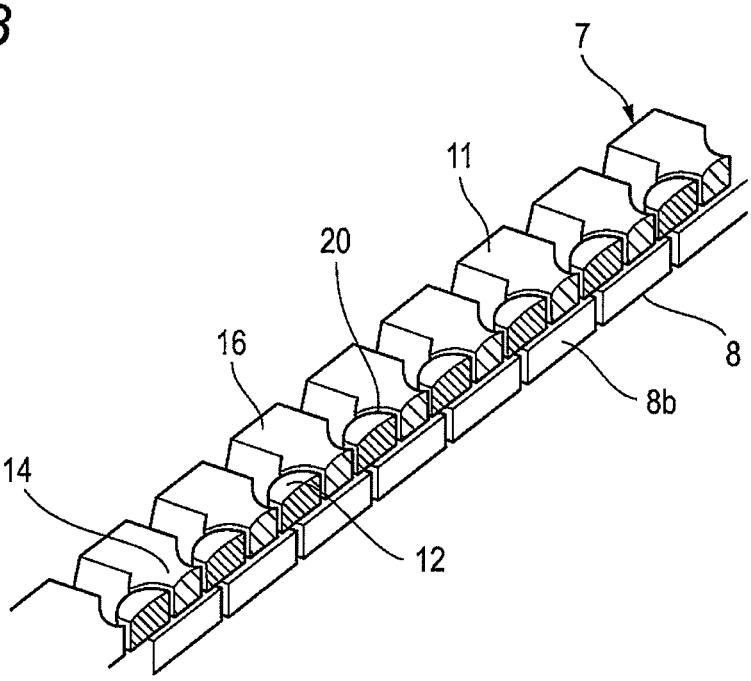
FIG. 8 is a partially cross-sectional perspective view of the second (rear) face of the slide fastener shown in FIG. 2.
Figure 9:
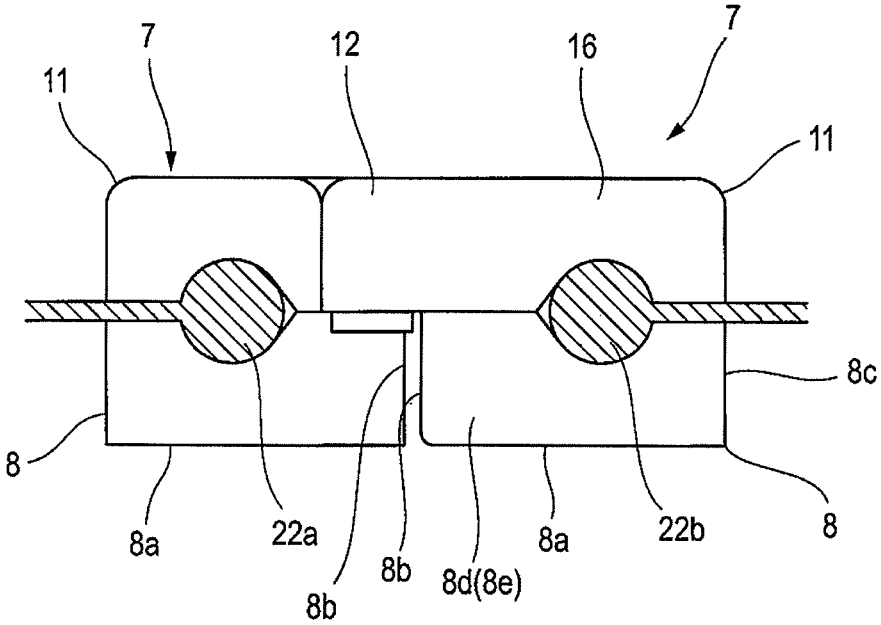
FIG. 9 is a cross-sectional view of a slide fastener according to the present invention.

In the embodiment shown in FIG. 1, each coupling element 7 comprises a first portion 8 at an upper side in a vertical direction of the coupling element 7 and a second portion 11 at a lower side. The first portion 8 is a first non-connecting portion. The first (upper) part 8 has a flat upper surface 8*a* and has a substantially rectangular or square shape. In particular, the upper surface 8*a* of the first portion 8 is substantially square in shape when seen from an upper surface side of the tape. The upper surface 8*a* of the first portion 8 is a horizontal surface with respect to upper surfaces of the tapes 5*a*, 5*b* and positioned within a horizontal plane essentially equal to the upper surfaces 8*a* of neighbouring coupling elements 7 in a longitudinal direction of the tapes 5*a*, 5*b*. Further, as shown in FIGS. 8 and 9, the first portion 8 has a front surface 8*b* and rear surface 8*c* which extend downward from a peripheral edge of the upper surface 8*a* and are opposed in a front and rear direction of the coupling element 7, and side surfaces 8*d*, 8*e* which are opposed in a left and right direction of the coupling element 7. Here, the front and rear direction of the coupling element 7 means a direction perpendicular to the longitudinal direction of the tape and the left and right direction of the coupling element 7 means a direction parallel with the longitudinal direction of the tape. The front surface 8*b* is located outside of the tape from a longitudinal edge of the tape 5*a*, 5*b* and is opposed to a front surface of the coupling element coupled to each other. The rear surface 8*c* is opposite to the front surface 8*b* and is located inside of the tape from the longitudinal edge of the tape 5*a*, 5*b*. Each side surface 8*d*, 8*e* extends in the front and rear direction of the coupling element 7 and in parallel with each other. Accordingly, in the first portion 8, the width of the coupling element 7 in the left and right direction is constant in the front and rear direction of the coupling element 7. The coupling elements 7 are secured in place along opposing longitudinal edges of the tapes 5*a*, 5*b*. As seen in FIG. 1, the coupling elements 7 are arranged such that the coupling elements 7 on opposing tapes 5*a*, 5*b* are offset with respect to one another in the longitudinal direction of the tape when the coupling elements 7 on the opposing tapes 5*a*, 5*b* are coupled. The shape of the coupling elements 7 ensures a 'close-packing' arrangement when the slide fastener 10 is in the closed position. In particular, the left and right side surfaces 8*d*, 8*e* of the first portion 8 of each coupling element 7 are parallel to a tape width direction which is perpendicular to the longitudinal direction of the tape and the left side surface 8*d* and right side surface 8*e* of the adjacent coupling elements 7 are opposed to each other with a slight gap therebetween. Further, the front surface 8*b* of the upper portion 8 of each coupling element 7 is parallel to the longitudinal direction of the tapes 5*a*, 5*b* and the front surfaces 8*b* of the opposing coupling elements 7 are opposed to each other with a slight gap therebetween when the opposing coupling elements 7 are coupled. Consequently, the gap between individual coupling elements 7 on the first tape 5*a* and also individual coupling elements 7 on the second tape 5*b* is particularly small when the slide fastener 10 is closed.

The slide fastener 10 therefore has a smooth, 'block paving' type appearance which is both aesthetically pleasing to the eye and to touch.

In addition, the closely packed arrangement of the coupling elements 7 in the closed appearance and the smooth nature of the coupling elements 7 ensures that material, to which the slide fastener 10 is secured, is not readily trapped between the coupling elements 7. In addition, if by chance material is trapped in the slide fastener 10 the coupling elements 7 will cause less or no damage to the material.

In FIG. 2 there is illustrated a perspective view of the reverse side of the slide fastener 10 of FIG. 1 in the closed position. In FIG. 2 the coupling elements 7 are again depicted in a closed arrangement.

From the lower side of the slide fastener 10 the interdigitation of opposing coupling elements is visible.

The second portion 11 of each coupling element is a second connecting portion which comprises a head region 12, a body region 16 and a neck region 14. The head region 12 protrudes in the left and right direction of the coupling element and engageable with a head region of a coupling element coupled to each other. The body region 16 comes in contact with a lower surface of the tape 5*a*, 5*b* and fixed to the tape 5*a*, 5*b* by clipping the code between the second portion 11 and the first portion 8. The neck region 14 is disposed between the head region 12 and the body region 16 and has a constricted shape so that the thickness of the neck region 14 in the left and right direction of the coupling element 7 is thinner than that of the head region 12 and the body region 16. As shown in FIG. 9, the head region 12 extends beyond the first portion. In particular, the head region 12 protrudes toward the front of the coupling element 7 from the front surface 8*b* of the first portion. The second portion is longer than the first portion by an amount equal to substantially the size of the head region in the front and rear direction of the coupling element 7.

Between adjacent coupling elements 7 on each tape 5*a*, 5*b* there is a cup region 20. The cup region 20 is a gap provided between the neck regions 14 of adjacent coupling elements 7. When the slide fastener 10 is in the closed position, the head region 12 of a coupling element 7 on the first tape 5*a* fits into the cup region 20 formed by adjacent coupling elements 7 on the second tape 5*b*.

Again, it can be seen from FIG. 2 that the close packing arrangement of the coupling elements 7 ensures that the coupling elements 7 are held securely. Indeed, if one tries to pull the coupling elements 7 apart perpendicularly to the direction of the path of the slider when the slide fastener 10 is closed, the head regions 12 on opposing coupling elements 7 abut one another preventing the slide fastener 10 from readily opening.

Figure 3:
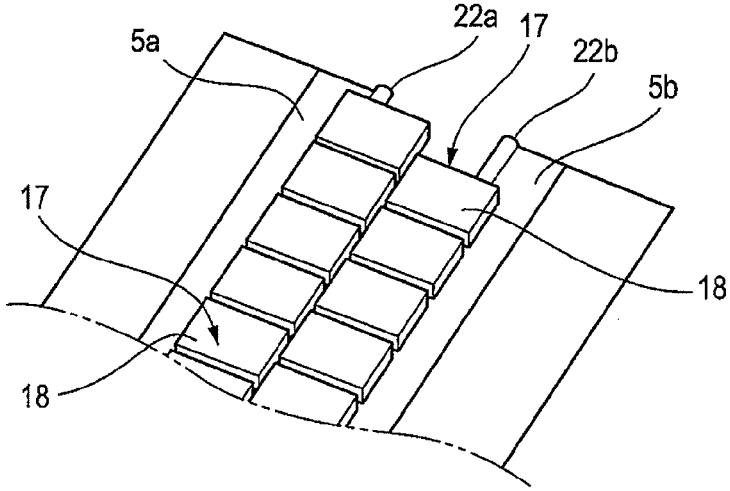
FIG. 3 is a partial enlarged perspective view of a first (front) face of a slide fastener according to a second embodiment of the present invention in the closed position.

In FIG. 3 there is illustrated a partial enlarged perspective view of a slide fastener according to a second embodiment of the present invention. The slide fastener again comprises a pair of stringers comprising a pair of opposing tapes 5*a*, 5*b*. Coupling elements 17 are mounted along the longitudinal edge of the tapes 5*a*, 5*b*. The coupling elements 17 are secured by conventional means along cords 22*a*, 22*b* on inside edges of the tapes 5*a*, 5*b* respectively.

The coupling elements 17 in FIG. 3 are arranged in a similar manner to the coupling elements 7 in FIG. 1. That is, the coupling elements 17 are close packed and are offset with respect to one another in the longitudinal direction of opposing tapes 5*a*, 5*b* when the slide fastener is in the closed position. However, in FIG. 3, the first portion 18 of the coupling element 17 has a flat upper surface 18*a* and has a substantially rectangular or square shape. In particular, the upper surface 18*a* of the first portion 18 is substantially rectangular in shape when seen from the upper surface side of the tape.

Figure 4:
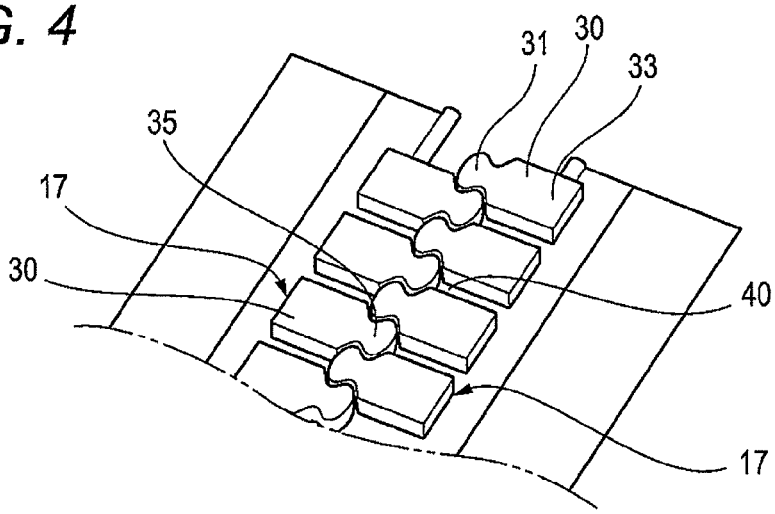
FIG. 4 is a partial enlarged perspective view of a second (rear) face of the slide fastener shown in FIG. 3 according to the second embodiment of the present invention in the closed position.

FIG. 4 illustrates a position of the lower side of the slide fastener of FIG. 3. The coupling elements 17 visible in FIG. 4 has a second portion 30 below the first portion 18. The second portion 30 comprises a head portion 31, a body portion 33 and a neck portion 35. The head portion 31 protrudes in the left and right direction of the coupling element and engageable with a head portion of a coupling element coupled to each other. The body portion 33 comes in contact with the lower surface of the tape 5*a*, 5*b* and fixed to the tape 5*a*, 5*b* by clipping the code 22*a*, 22*b* between the second portion 30 and the first portion 18. The neck portion 35 is disposed between the head portion 31 and the body portion 33 and has a constricted shape so that the thickness of the neck portion 35 in the left and right direction of the coupling element 7 is thinner than that of the head portion 31 and the body portion 33.

The body portion 33 is elongate in a front and rear direction of the coupling element 17 and the head portions 31 of coupling elements 17 on opposing tapes 5*a*, 5*b* fit between cup regions 40 formed by adjacent coupling elements 17 on each tape 5*a*, 5*b*. The cup region 40 is a gap provided between the neck portions 35 of adjacent coupling elements 17.

Figure 5:
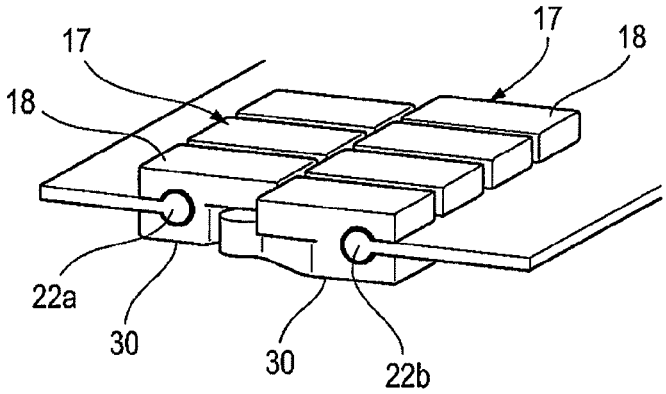
FIG. 5 is a partially cross-sectional perspective view of the slide fastener shown in FIG. 3 according to the second embodiment in the closed position.

In FIG. 5, the substantially flat nature of the coupling elements 17 when the slide fastener is in the closed position is apparent.

Figure 6:
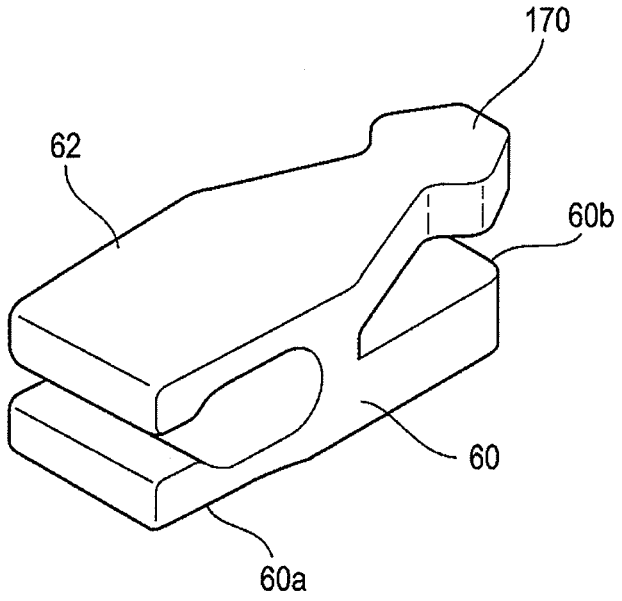
FIG. 6 is a perspective view of an alternative coupling element used in the slide fastener according to the present invention.
Figure 7:
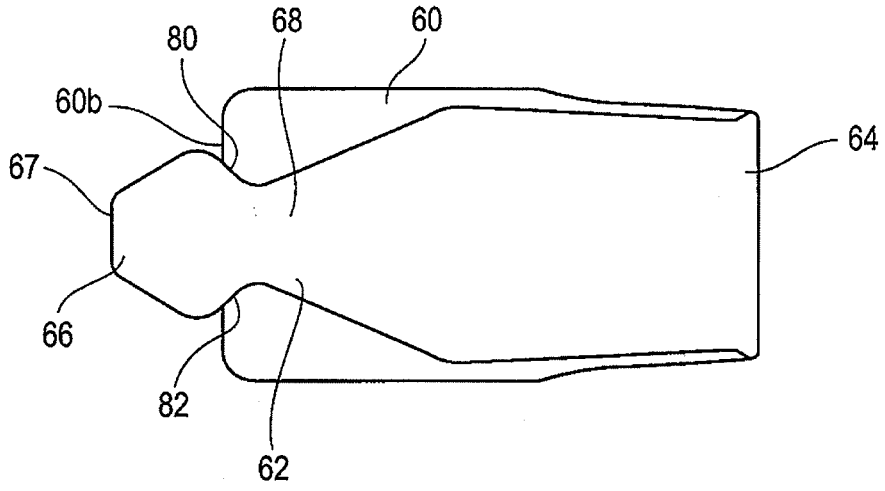
FIG. 7 is a plan view of a second portion of the alternative coupling element shown in FIG. 6 according to the present invention.

In FIGS. 6 and 7 alternative coupling elements comprised of metal for a slide fastener according to the present invention are considered in more detail.

In FIG. 6 there is depicted a coupling element 170 prior to attachment to a tape of a slide fastener according to the present invention. In FIG. 6 the coupling element can be seen to comprise a first portion 60 and a second interconnecting portion 62. The first portion 60 has a flat upper surface 60*a* and has a substantially rectangular or square shape. In particular, the upper surface 60*a* of the first portion 60 is substantially rectangular in shape when seen from an upper surface side of the tape. As described previously, the second interconnecting portion 62 comprises a body portion 64 fixed to the tape and a head portion 66 connected via a constricted neck region 68. The head portion 66 is in the form of a blunted arrow head. As is also visible from FIGS. 6 and 7, the head portion 66 of the second interconnecting portion 62 extends forward beyond a front surface 60*b* of the first portion 60 by an amount substantially equal to the head portion 66 of the second interconnecting portion 62. Consequently, when the slide fastener is in the closed position and the head portions 66 on individual coupling elements 170 fit between the cup portions or regions formed by adjacent coupling elements 170 on opposing tapes, the interengaging second portions 62 connect in an arrangement in which the first portions 60 are closely packed one another. Preferably, the second portions 62 connect in a closely packed arrangement such that the first portions 60 abut one another closely.

In addition, the head portions 66, comprise receding edges 80 and 82. Receding edges 80, 82 are inclined so as to gradually reduce a thickness of the head portion 66 in a left and right direction toward the neck region 68. When the second interconnecting portions 62 on neighbouring coupling elements 170 interdigitate the receding edges 80, 82 interlock with a head portion 66 on a neighbouring coupling element 170, and hence receding edges 80, 82 on an opposing tape. The head portion 66 extends beyond the first portion 60. In particular, the head portion 66 protrudes toward the front of the coupling element 170 from the front surface 8*b* of the first portion 60. The second portion 62 is longer than the first portion 60 by an amount equal to substantially the size of the head portion 66 in the front and rear direction of the coupling element 170. Here, the size of the head portion means a length from a front end 67 of the head portion 66 to the receding edges 80, 82 in the front and rear direction of the coupling element 170.

Surprisingly, the inventors have now found that whilst the coupling elements 170 comprise a first portion 60 and a second portion 62 and whilst it is only the second portion 62 of the coupling elements 170 which interdigitate in the closed slide fastener, when the slide fastener is in the closed position the strength of attachment of the coupling elements 170 is surprisingly strong. This is surprising since effectively only half of each coupling element 170 is engaged in interdigitation in the closed slide fastener. Nevertheless, it has been found that it is surprisingly difficult to separate the interdigitating coupling elements 170 when in the closed or locked position. Further, it has been found that when the slide fastener is in the closed position the engaged coupling elements 170 still allow the slide fastener to have great flexibility such that the coupling elements 170 are not readily separated even when the closed slide fastener is flexed along the longitudinal length of the slide fastener.

In FIG. 8 there is illustrated a partially cross-sectional perspective view of the reverse side of the slide fastener 10 as illustrated in FIG. 2. In FIG. 8 the head portions 12 of the coupling elements 7 are seen located in the cup regions 20 between adjacent coupling elements 7 on an opposing tape.

Likewise, in FIG. 9 a cross-sectional view of a slide fastener according to the present invention is depicted. In FIG. 9 it can be seen how the second interconnecting portion 11 of each coupling element 7 bridges the gap between the first non-connecting portions 8 of coupling elements 7 on the opposing side of the slide fastener when the slide fastener is in the closed position. Front faces 8*b* of the first non-connecting portions 8 of the opposing coupling elements 7 are close to each other with a slight gap therebetween.

As mentioned previously, the present invention allows the manufacture of a smooth and attractive slide fastener which has the versatility to be made using not only coupling elements comprised of plastics material prepared by for example injection moulding, but which can also be made using metal fastening elements.

A further feature of the slide fastener of the present invention is that due to the close fitting arrangement of the front facing portions of the substantially flat coupling elements, the slide fastener is suited to applications where waterproof features are required and where it is desirable to have not only a smooth and aesthetically pleasing slide fastener but also one which is at least to some extent a water proof slide fastener. Such applications are particularly suited for outdoor pursuits clothing but is not limited thereto.

To this end, the tapes of the slide fastener to which the coupling elements, either plastic or metal are attached, are treated prior to attaching the coupling elements to the tapes.

For example, the tapes may be treated with a water proof film or layer prior to injection moulding or crimping the coupling elements thereto such that the coupling elements further secure the film or layer in place. Alternatively, a water proof film or layer may be applied so that it abuts the coupling elements or while not actually abutting the coupling elements substantially covers the tapes. In this case the film or layer may be applied after the attachment of the coupling elements. The waterproof layer or film is preferably comprised of a polymeric material for example polyurethane and is applied by for example laminating.

In addition, the waterproof layer or film may be printed with a pattern to compliment the slide fastener or the garment or article to which the slide fastener is attached.

Alternatively, the tapes may be treated with a hydrophobic material or instead of the usual polyester; the yarn used to knit or weave the tapes may be comprised of a hydrophobic material.

The invention claimed is:

1. A slide fastener comprising:

a pair of first and second stringers each comprising a tape and a row of coupling elements mounted on a longitudinal edge of the tape, wherein:

each of the coupling elements comprises a first non-connecting portion at an upper side of the tape and a second connecting portion at a lower side of the tape, the second connecting portion comprises a head portion and a body portion, the head portion is engageable with a head portion of opposing coupling element, the body portion is fixed to the tape, in a direction perpendicular to a longitudinal direction of the first and second stringers, the second connecting portion is longer than the first non-connecting portion by an amount equal to substantially the size of the head portion of the second connecting portion, a shape of each of the coupling elements of the first stringer is identical with a shape of each of the coupling elements of the second stringer, the first non-connecting portion of each of the coupling elements is substantially square, in the longitudinal direction of the first and second stringers, the length of the head portion is less than the length of the body portion and the length of the head portion is less than the length of the first non-connecting portion, and wherein each of the coupling elements is fixed to the tape by clipping the tape between the first non-connecting portion and the second connecting portion.

2. The slide fastener according to claim 1, wherein the first non-connecting portion has a flat upper surface.

3. The slide fastener according to claim 1, wherein the first non-connecting portion has a front surface opposing in a front and rear direction of the coupling element when the head portion engages with the head portion of the opposing coupling element.

4. The slide fastener according to claim 1, wherein the first non-connecting portion has a front surface and a rear surface which is arranged opposite to the front surface which are arranged parallel to the longitudinal direction of the first and second stringers.

5. The slide fastener according to claim 4, wherein the second connecting portion has a rear surface which is arranged opposite to the head portion, and wherein the rear surface of the second connecting portion and the rear surface of the first non-connecting portion are flush with one another in a plane perpendicularly intersecting the tape.

* * * * *